US006234885B1

(12) United States Patent
Haferkorn

(10) Patent No.: US 6,234,885 B1
(45) Date of Patent: May 22, 2001

(54) ROLL GRINDING MACHINE

(75) Inventor: Wolfgang Haferkorn, Frankfurt am Main (DE)

(73) Assignee: Waldrich Siegen Werkzeugmaschinenfabrik GmbH, Burbach (DE)

( * ) Notice: Subject to any disclaimer, the term of this patent is extended or adjusted under 35 U.S.C. 154(b) by 0 days.

(21) Appl. No.: 09/355,175

(22) PCT Filed: Nov. 27, 1998

(86) PCT No.: PCT/EP98/07623

§ 371 Date: Oct. 12, 1999

§ 102(e) Date: Oct. 12, 1999

(87) PCT Pub. No.: WO99/28085

PCT Pub. Date: Jun. 10, 1999

(30) Foreign Application Priority Data

Nov. 27, 1997 (DE) ..... 297 12 000 U

(51) Int. Cl.[7] ..... B24B 5/00

(52) U.S. Cl. ..... 451/290; 451/49; 451/121; 451/142; 451/251

(58) Field of Search ..... 451/49, 121, 142, 451/146, 251, 258, 290, 155, 157

(56) References Cited

U.S. PATENT DOCUMENTS 3,469,353 9/1969 Klein .
4,077,163 * 3/1978 Bennett, Jr. et al. ..... 451/49
5,447,463 * 9/1995 Schmitz ..... 451/49
5,618,224 * 4/1997 Dumas ..... 451/49
5,738,570 * 4/1998 Rosenthal et al. ..... 451/49
5,997,389 * 12/1999 Dai Pan et al. ..... 451/142

FOREIGN PATENT DOCUMENTS 3726055 2/1989 (DE) .
0333352 9/1989 (DE) .
4159067 * 2/1992 (JP) .

OTHER PUBLICATIONS

Patent Abstracts of Japan (European Patent Office) 4159067 Feb. 6, 1992.

* cited by examiner

*Primary Examiner*—Joseph J. Hail, III
*Assistant Examiner*—George Nguyen
(74) *Attorney, Agent, or Firm*—Brown & Wood, LLP

(57) ABSTRACT

In a roll grinding machine (2) for profile grinding of rolls with a constructionally simple device for a very precise adjustment of a grinding wheels (4) supported on a grinding spindle (7) tangentially with respect to a roll profile, the grinding spindle (7) is arranged in a rotatable sleeve (8) the longitudinal axis (9) of which is inclined at an angle (10) relative to the longitudinal axis (11) of the grinding spindle (7).

6 Claims, 4 Drawing Sheets

ROLL GRINDING MACHINE

FIELD OF THE INVENTION

The invention relates to a roll grinding machine for profile grinding of rolls with a device for adjusting a grinding wheel supported on a grinding spindle tangentially with respect to a roll profile.

BACKGROUND OF THE INVENTION

Such roll grinding machines are used, e.g., for grinding working and support rolls used in sheet metal rolling mills, plastic plate rolling mills, and calenders. These rolls always have, as a rule, a shape which deviates from a pure cylindrical shape, and have a concave or crowned profile or a combination of both. During grinding of these profiles, it proved to be disadvantageous that a grinding wheel, because of its shaft or grinding spindle extending parallel to its axis, almost always grinds the roll with an edge and thus does not contact the roll along its entire surface. As a result, the grinding is effected with a very small longitudinal feed to avoid the formation of steps in the roll, with a corresponding resulting increase of the grinding time.

To eliminate this drawback since long ago, it is known to so pivot the grinding wheel-supporting spindle and to adjust it with respect to the roll that the grinding wheel always engages the profile tangentially to a most possible extent, whereby the grinding can be effected with approximately an entire wheel width. In order to achieve this, the roll grinding machines are designed with a possibility of a pivotal movement of the upper rest. This, however, requires not only an additional separation of the support. In addition, on one hand, it is very difficult to achieve an absolutely hysteresis-free pivotal movement about a stationary point and, on the other hand, to achieve simultaneously the necessary for the grinding process damping in the separation surface.

BRIEF SUMMARY OF THE INVENTION

Accordingly, an object of the present invention is a roll grinding machine of the above-described type in which the tangential adjustment of the grinding wheel is improved, and, in particular, is structurally simplified and, further, is possible with a greater precision.

This object is achieved according to the invention by arranging the grinding spindle in a rotatable sleeve formed, preferably, as an eccentric sleeve the longitudinal axis of which is inclined at an angle toward the longitudinal axis of the spindle. Thereby, unexpectedly, it became possible in a simple manner to adjust the grinding wheel with a reproducible precision of 1/100 $\mu$m by rotating the sleeve about the spindle, and actually independent of a cost-effective manufacturing of the roll profile, so that a desired adjustment is obtained with any geometry. Upon rotation of the sleeve, the grinding spindle, which is connected with an appropriate mechanism, is displaced with a main motion in the plan of the workpiece center and the grinding spindle center and is positioned at an angle, which corresponds to the amount of rotation, to the central axis of the workpiece. This angle can be calculated as a tangent to a curve by a NC-control unit of a high order computer and which is connected with the roll grinding machine.

According to a preferred embodiment of the invention, the point of intersection of both longitudinal axes lies in the center of the grinding wheel. Because of this stationary intersection point, the grinding spindle can be adjusted without a substantial change of the distance between the centers of the workpiece or the roll and of the grinding spindle. The precision of the tangential adjustment is further increased because of this.

When, advantageously, both the sleeve and the eccentric bushing are preloaded at their both ends, the precision of the grinding wheel adjustment is increased even further. For effecting the preloading, hydrostatic bearings or pre-loaded roller guides which, because of the rotational movement during the adjustment of the grinding spindle, can be used without any problem, are employed. A very large transmission ratio which is achieved according to the invention, between the rotational angle of the sleeve and the rotational angle of the grinding spindle, contributes, in addition, to that the adjustment movement of the grinding wheel upon its adjustment with respect to the roll profile, is reduced by this transmission ratio in proportion of about 1:100.

According to one embodiment of the invention, the sleeve is arranged on a grinding spindle-receiving eccentric bushing. In this way, the grinding spindle is not any more arranged directly in the inclined sleeve but in the inner eccentric busing so that a double eccentricity, which is particular suitable for fine adjustments, is achieved.

BRIEF DESCRIPTION OF THE DRAWINGS

Further particularities and advantages of the present invention follow from the claims and the following description in which an embodiment example of the subject matter of the invention is explained in detail. It is shown in:

DETAILED DESCRIPTION OF THE INVENTION

Figure 1:
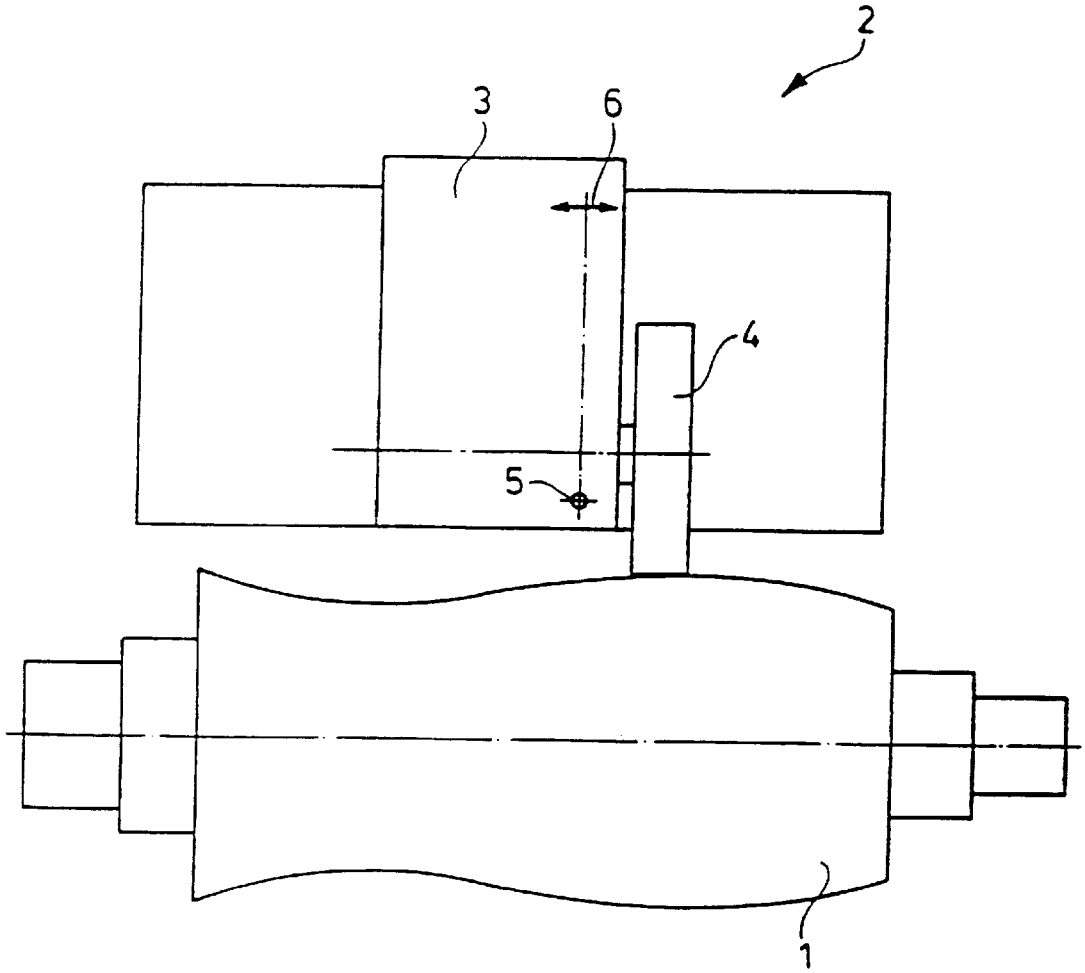
PRIOR ART FIG.1
FIG. 1 a schematic front view of a conventional per se known, roll grinding machine with a grinding wheel adjustable in accordance with a roll profile by a pivotal movement of an upper rest as practiced in the prior art.
Figure 2:
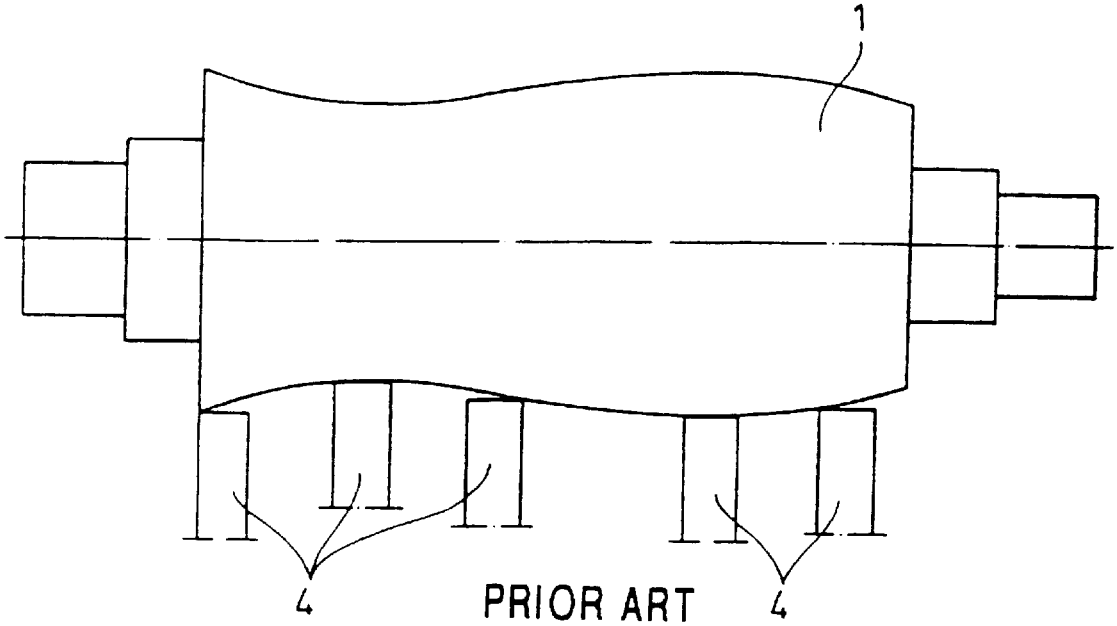
PRIOR ART FIG.2
FIG. 2 a detail of FIG. 1 showing a grinding wheel in different adjustable positions along the length of a to-be-ground roll.
Figure 3:
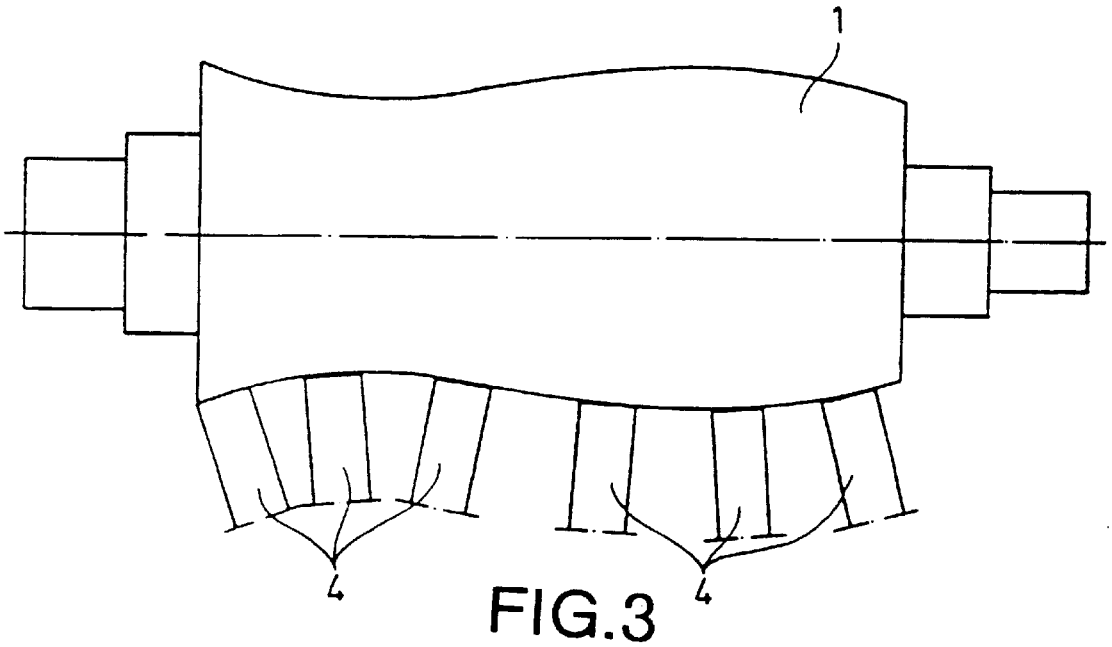
FIG. 3 a variant of FIG. 2 showing a tangentially adjusted grinding wheel to the roll profile along approximately the entire wheel width.

In order to avoid the illustrated positioning of a grinding wheel 4 along the length of a roll, 1 in different operational positions, as shown in FIG. 2, with only an edge engaging the roll during grinding of the profile of the work or support roll 1 on a roll grinding machine 2 shown, for simplicity sake, schematically in FIG. 1 which shows essentially only an upper rest 3 and the grinding sheel 4, and instead to achieve, according to FIG. 3, tangential positioning of the grinding wheel 4 shown here again in different operational positions in accordance with the conventional embodiment shown in FIG. 1, the entire upper rest 3 is pivoted about a point 5 in directions shown with a double arrow 6. This pivotal movement brings with it the above-discussed drawbacks.

Figure 4:
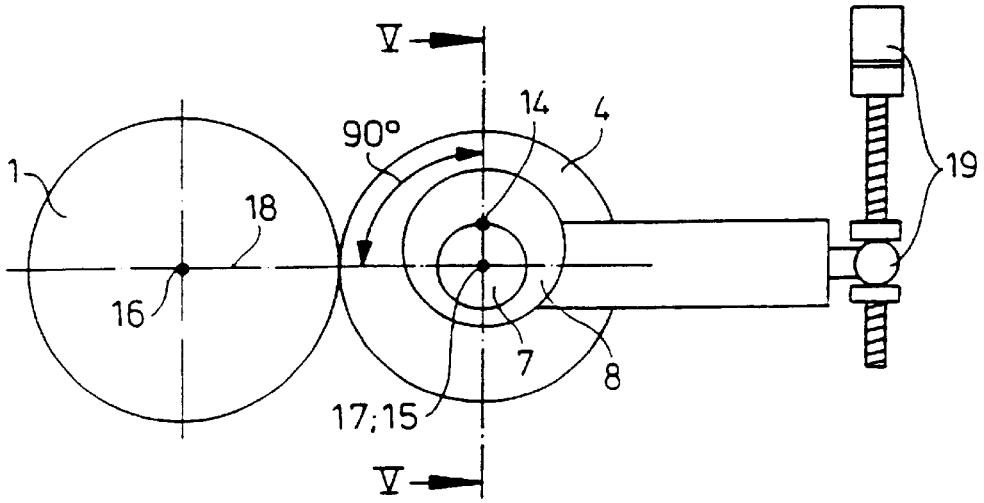
FIG. 4 a substantially simplified front view of a grinding wheel supported on an eccentric sleeve and adjustable in accordance with the roll profile.
Figure 5:
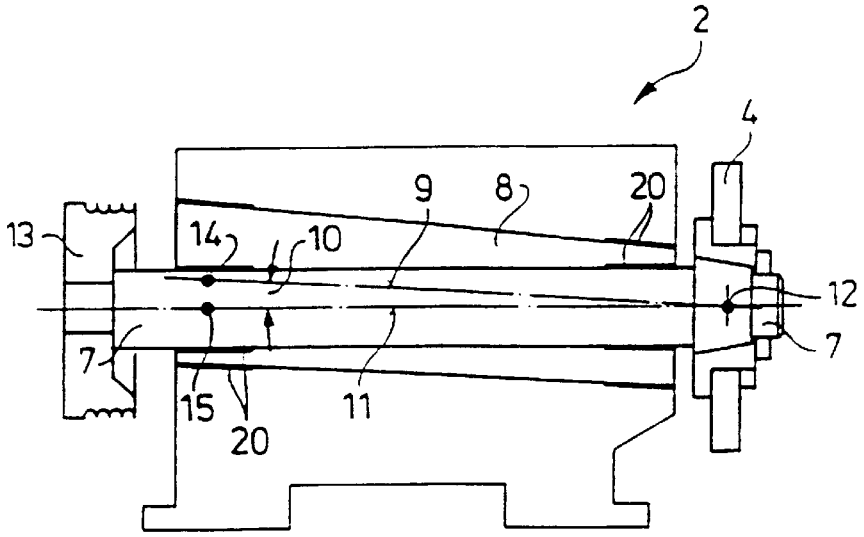
FIG. 5 a cross-sectional view along line V—V in FIG. 4.
Figure 6:
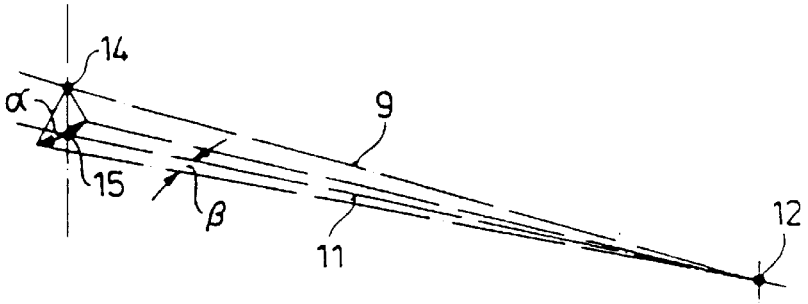
FIG. 6 a detail of a schematic diagram of the kinematics during adjustment of the grinding wheel by rotation of the eccentric sleeve according to FIGS. 4 and 5.

Achieving the tangential positioning of the grinding wheel 4 without changing the position of the upper rest 3, i.e., without the need to pivot the same, is possible, with an embodiment according to FIGS. 4–6, by mounting a grinding spindle 7, which supports the grinding wheel 4, in a rotatable sleeve 8 formed as an eccentric sleeve, rotatable about the grinding spindle 7, and having its longitudinal axis 9 extending at an angle 10 to a longitudinal axis of the grinding spindle 7. In this embodiment example, the cross-sectional point 12 of both longitudinal axes 9 and 11 lies in the center of the grinding wheel and is, therefore, fixed. The grinding spindle 7 has its end, remote from the grinding wheel 4, connected by drive means 13 with a drive of the roll grinding machine, not shown.

A zero position of the grinding wheel is shown in FIG. 4 in which points 14 and 15 taken on the longitudinal axis 9 of the sleeve 8 and on the longitudinal axis 11 of the grinding spindle 7 (compare FIG. 5 and FIG. 6) lie exactly at an angle of 90° to a line of 18 which connects, accordingly to FIG. 4, the roll center 16 with the grinding spindle center 17 which coincides with the points 15. Upon beginning of rotation of the sleeve 8 by adjusting means recirculating ball screw drive 19, shown schematically in FIG. 4 and connected, advantageously, with a high-order computer, the point 15 executes, accordingly to FIG. 6, a main motion in the plane of the longitudinal axis 11 of the grinding spindle 7, with the cross-sectional point 12 of both longitudinal axes 9 and 11 remaining stationary. The grinding spindle 7 occupies a position corresponding to an adjustable value at an angle 10 to the roll center 16, without changing the distance between the roll center 16 and the grinding spindle center 17 in any substantial manner. A large mechanical transmission ratio, which reduces the feed motion in proportion of about 1:100 exists between the pivot angle a of the sleeve 8 and the pivot angle β of the grinding spindle 7 (see the kinematics according to FIG. 6).

Figure 7:
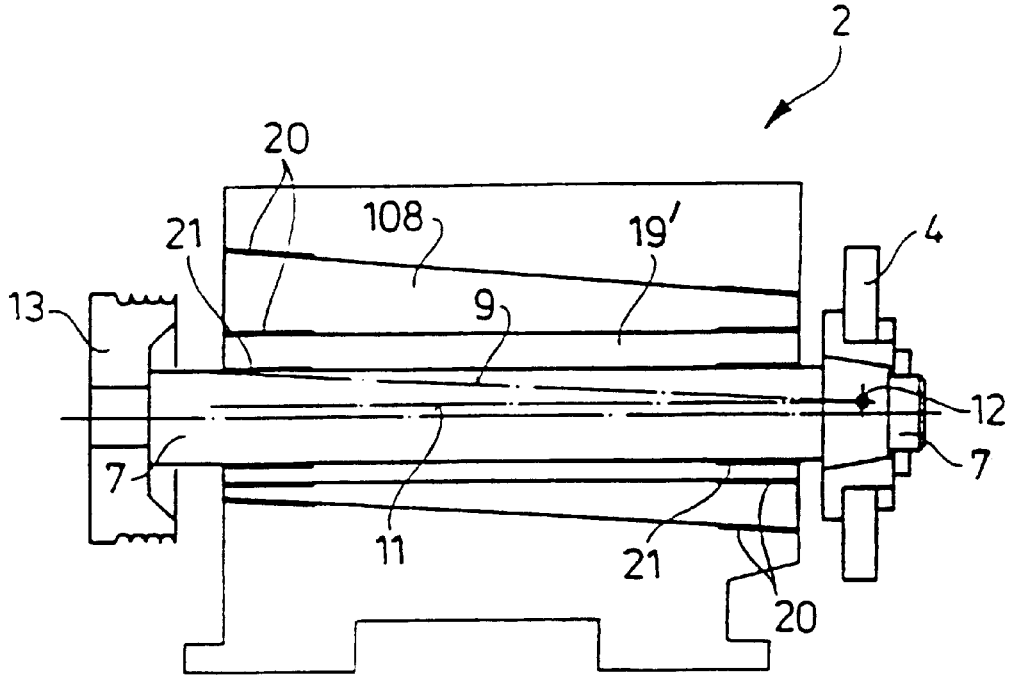
FIG. 7 a view corresponding to FIG. 5 and showing positioning of a grinding spindle which is arranged here with a double eccentricity.

During the execution of the tangential adjustment of the grinding wheel according to FIG. 7, the grinding spindle 7 is arranged in an eccentric bushing 19' which is concentrically surrounded by an outer sleeve 108 inclined relative to the longitudinal axis 11 of the grinding spindle 7. In addition to the above-described very precise adjustment of the grinding wheel 4 with respect to the profile of the roll 1, the double eccentricity, which is obtained by nested arrangement of the eccentric bushing 19' and the inclined sleeve 108, provides for a very precise adjustment of the tracking movement of the grinding wheel 4.

The arrangement for effecting rotational movements for adjusting the grinding wheel 4 contemplates providing the sleeve 8 or 108 and the eccentric sleeve 19 at their respective opposite ends with respective hydraustatic bearings 20 and 21 which permit preloading of the sleeves 8 or 108 and 19. The hydraustatic bearings 20 and 21 are shown schematically in FIGS. 5 and 7, without showing the conduits for the pressure medium. In both embodiments (FIG. 5 and FIG. 7), it is possible to tangentially adjust the grinding wheel 4 with respect to the profile of a respective roll with high precision, with the double eccentricity according to FIG. 7 enabling additional fine adjustment.

What is claimed is:

1. A roll grinding machine for profile grinding of rolls, comprising a device for tangentially adjusting a grinding wheel supported on a grinding spindle with respect to a roll profile, characterized in that grinding spindle (7) is supported in a rotatable sleeve (8; 108) a longitudinal axis (9) of which is inclined relative to a longitudinal axis (11) of the grinding spindle (7) at an angle (10).

2. A roll grinding machine according to claim 1, characterized in that a point of intersection (12) of both longitudinal axis (9 and 11) lies in a center of the grinding wheel (4).

3. A roll grinding machine according to claim 1 or 2, characterized in that the sleeve (8; 108) is formed as an eccentric sleeve.

4. A roll grinding machine according to claim 1, characterized in that the sleeve (8; 108) is preloaded at both ends thereof.

5. A roll grinding machine according to claim 1, characterized in that the sleeve (8) is concentrically arranged on a grinding spindle—receiving eccentric bushing (19).

6. A roll grinding machine according to claim 5, characterized in that the eccentric bushing (19') is preloaded at both ends thereof.

* * * * *